US006444166B1

(12) United States Patent
Garrett

(10) Patent No.: US 6,444,166 B1
(45) Date of Patent: Sep. 3, 2002

(54) RETICULATED FOAM STRUCTURES

(75) Inventor: Michael E. Garrett, Woking (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 09/576,894

(22) Filed: May 24, 2000

(30) Foreign Application Priority Data

May 26, 1999 (GB) ..... 9912215

(51) Int. Cl.[7] ..... B22F 3/10
(52) U.S. Cl. ..... 419/2; 419/29
(58) Field of Search ..... 419/2, 29

(56) References Cited

U.S. PATENT DOCUMENTS 3,847,591 A * 11/1974 Niebylski et al. ..... 75/20 F
4,099,961 A * 7/1978 Patten ..... 75/20 F
5,151,246 A * 9/1992 Baumeister et al. ..... 419/2

FOREIGN PATENT DOCUMENTS

| | | |
|---|---|---|
| DE | 962 565 | 4/1957 |
| EP | 0 903 415 | 3/1999 |

* cited by examiner

*Primary Examiner*—Daniel J. Jenkins
(74) *Attorney, Agent, or Firm*—Joshua L. Cohen; Salvatore P. Pace

(57) ABSTRACT

A method of making a metal foam object includes the steps of mixing a gasifier with metal powder and subjecting the mixture to an elevated temperature $T_1$ and pressure $P_1$ to form a sintered sheet; placing at least a portion of the sintered sheet into a mold and subjecting the mold to a temperature $T_2$ where $T_2$ is greater than $T_1$ at which the metal melts and the gas is released from the gasifier; quenching the metal foam object thus formed in the mold; and passing a hot inert gas through the metal foam object.

3 Claims, 1 Drawing Sheet

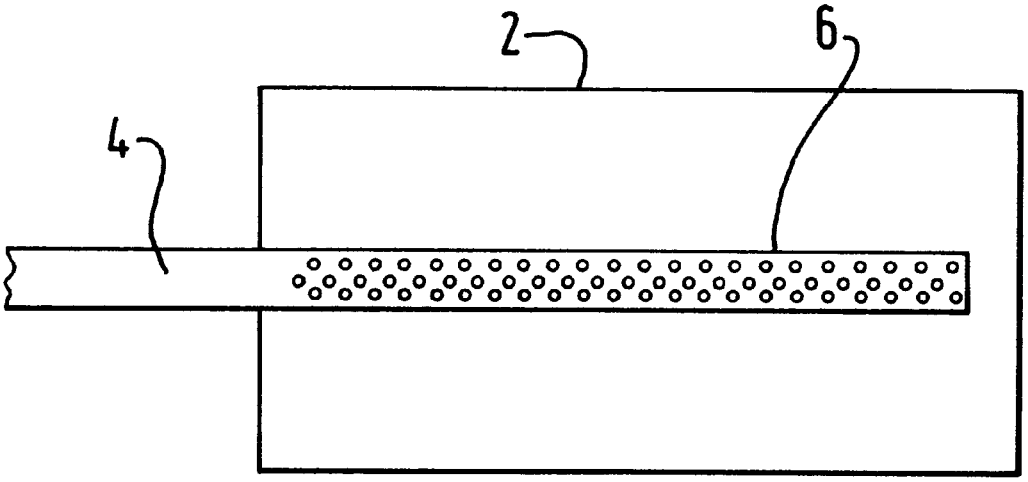
2
6
4

RETICULATED FOAM STRUCTURES

BACKGROUND OF THE INVENTION

Foam structures are known in industry and the number of applications for metallic foam structures is continually increasing. For example, aluminium foam metal having a continuously connected, open celled (reticulated) geometry is available and employed in energy/impact absorbers, heat exchangers and lightweight composite panels.

When used with heat exchangers the high surface to volume ratio allows for a compact design and the high specific stiffness, that is, high strength to weight ratio makes the material useful in aerospace and car applications.

Low-cost aluminium foam panels can be produced by a continuous casting process. The foam is machinable by common aluminium metal working techniques (sawing, drilling, milling) and maybe joined by brazing or adhesive bonding. As previously indicated aluminium foam produced by this method finds application as lightweight cores for sandwich panels and as components in energy absorbing structures.

However, when gas containment vessels are required and in particular when irregular complex shapes are required then metal foams are formed typically by mixing small quantities of a gasifier e.g. titanium nitride with aluminium powder and subjecting the mixture to heat and pressure to form a sintered sheet.

The sintered sheet or a portion thereof is then placed in a mold which is then heated to a higher temperature at which the metal melts and nitrogen is released from the titanium nitride to provide an even dispersion of bubbles.

The hot metal is allowed to solidify and then shock heat treated by dropping it into a cryogen such as liquid nitrogen which causes small fractures to occur between adjacent bubbles so that the mass becomes reticulated. However, by subjecting the mass to a violent heat shock said small fractures may be prone to brittle fracture and also create areas of crack propagation particularly if cyclic loading is applied to the object made from the mass.

It is an aim of the present invention to mitigate against these disadvantages by employing a hot inert gas which is passed through the mass such that thin metal adjacent the fractures melts slightly and is drawn in to a more circular cross-section by surface tension.

SUMMARY OF THE INVENTION

According to the present invention a method of making a metal foam object includes the steps of mixing a gasifier with metal powder and subjecting the mixture to an elevated temperature $T_1$ and pressure $P_1$ to form a sintered sheet, placing at least a portion of the sintered sheet in a mold and subjecting the mold to a temperature $T_2$ where $T_2$ is greater than $T_1$ at which the metal melts and the gas is released from the gasifier quenching the metal foam object thus formed by the mold and passing a hot inert gas through the metal foam object.

Preferably, the hot inert gas is argon which is passed through the metal foam object by means of at least one header tube.

BRIEF DESCRIPTION OF THE DRAWINGS

FIG. 1 is a block diagram of an apparatus for quenching metal foam objects.

DETAILED DESCRIPTION OF THE INVENTION

As shown, a gas containment vessel 2 made from metal foam using a manufacturing method including a shock heat treatment step includes at least one header tube 4 formed with holes/perforations 6.

DETAILED DESCRIPTION OF THE INVENTION

The appended Figure is a block diagram of an apparatus for quenching metal foam objects.

Two perforated header tubes 4 can be provided one at each end of the gas containment vessel 2 which header tubes 4 can later be utilized as valved tails for the vessel 2.

While the embodiment of the present invention has been described in detail, it is apparent that further modifications and adaptations of the invention will occur to those skilled in the art. However, it is to be expressly understood that such modifications and adaptations are within the spirit and scope of the invention.

I claim:

1. A method of making a metal foam object comprising the steps of:

mixing a gasifier with metal powder and subjecting the mixture to an elevated temperature $T_1$ and pressure $P_1$ to form a sintered sheet;

placing at least a portion of the sintered sheet into a mold and subjecting the mold to a temperature $T_2$ where $T_2$ is greater than $T_1$ at which the metal melts and a gas is released from the gasifier;

quenching the metal foam object thus formed in the mold; and passing a hot inert gas through the metal foam object by at least one header tube extending into the metal foam object.

2. The method of claim 1, wherein the hot inert gas is argon.

3. The method of claim 1 wherein the at least one header tube comprises at least one perforation through which the hot inert gas passes.

* * * * *